US007401681B2

(12) United States Patent
Iwayama et al.

(10) Patent No.: US 7,401,681 B2
(45) Date of Patent: Jul. 22, 2008

(54) MOUNTING SUPPORT DEVICE FOR CEILING EMBEDDED SPEAKER SYSTEM

(75) Inventors: Ken Iwayama, Nishinomiya (JP); Takashi Nishino, Jakarta Timur (JP)

(73) Assignee: TOA Corportion, Kobe-shi (JP)

( * ) Notice: Subject to any disclaimer, the term of this patent is extended or adjusted under 35 U.S.C. 154(b) by 188 days.

(21) Appl. No.: 10/542,998

(22) PCT Filed: Jan. 19, 2004

(86) PCT No.: PCT/JP2004/000372

§ 371 (c)(1),
(2), (4) Date: Dec. 19, 2005

(87) PCT Pub. No.: WO2004/066670

PCT Pub. Date: Aug. 5, 2004

(65) Prior Publication Data

US 2006/0231326 A1 Oct. 19, 2006

(30) Foreign Application Priority Data

Jan. 21, 2003 (JP) ..... 2003-012100

(51) Int. Cl.
*H04R 1/00* (2006.01)

(52) U.S. Cl. ..... 181/150; 248/287.1; 248/343

(58) Field of Classification Search ..... 181/150; 362/150; 248/287.1, 343
See application file for complete search history.

(56) References Cited

U.S. PATENT DOCUMENTS 1,121,568 A * 12/1914 McWilliams ..... 248/343
1,125,632 A * 1/1915 Ashton ..... 248/343
1,622,087 A * 3/1927 Calderwood ..... 248/343
2,443,859 A * 6/1948 Jacobs ..... 248/251
2,459,034 A * 1/1949 Kruger ..... 248/343
2,802,933 A * 8/1957 Broadwin ..... 362/366
2,854,205 A * 9/1958 Kruger ..... 248/343
2,920,853 A * 1/1960 Bufogle ..... 248/214
2,972,044 A * 2/1961 Smith ..... 362/150
3,018,082 A * 1/1962 Berger ..... 248/343
3,306,657 A * 2/1967 Turner ..... 296/97.6

(Continued)

FOREIGN PATENT DOCUMENTS

JP 49-21510 2/1974

(Continued)

OTHER PUBLICATIONS

International Search Report for International Application No. PCT/JP2004/000372 by the Japanese Patent Office dated Feb. 6, 2004 (1 page).

*Primary Examiner*—Lincoln Donovan
*Assistant Examiner*—Forrest Phillips
(74) *Attorney, Agent, or Firm*—Marshall, Gerstein & Borun LLP

(57) ABSTRACT

An auxiliary mounting device 10 for an in ceiling speaker system comprises a ceiling reinforcing element 11 and an elongate element 21. The ceiling reinforcing element 11 includes a flat plate portion 12 and a vertical portion 14 provided to extend vertically from the flat plate portion, 12. The vertical portion 14 is capable of being in a slidable state in which the vertical portion 14 is vertically slidable and in a fixed state in which the vertical portion 14 is fixed so as not to vertically displace.

11 Claims, 13 Drawing Sheets

U.S. PATENT DOCUMENTS 3,425,655 A * 2/1969 Cogdill ..... 248/343
3,511,463 A * 5/1970 Thomas et al. ..... 248/343
3,518,420 A * 6/1970 Kripp ..... 362/257
3,730,469 A * 5/1973 Shields ..... 248/265
3,872,296 A * 3/1975 Cohen et al. ..... 362/366
3,912,865 A * 10/1975 Seebinger ..... 381/124
4,041,657 A * 8/1977 Schuplin ..... 52/39
4,048,491 A * 9/1977 Wessman ..... 362/364
4,180,226 A * 12/1979 Matte ..... 248/27.1
4,227,355 A * 10/1980 Wendt ..... 52/64
4,230,900 A * 10/1980 Speet ..... 174/493
4,274,615 A * 6/1981 Chan et al. ..... 248/343
4,484,658 A * 11/1984 Grote ..... 381/395
4,497,014 A * 1/1985 Woloski et al. ..... 362/150
4,613,929 A * 9/1986 Totten ..... 362/150
4,673,149 A * 6/1987 Grote et al. ..... 248/343
4,712,168 A * 12/1987 Scherrer ..... 362/427
4,928,914 A * 5/1990 Snodell ..... 248/284.1
4,972,339 A * 11/1990 Gabrius ..... 362/366
5,000,274 A * 3/1991 Bullivant ..... 177/210 EM
5,009,383 A * 4/1991 Chapman ..... 248/343
5,069,411 A * 12/1991 Murphy ..... 248/476
5,072,344 A * 12/1991 Fabbri ..... 362/150
5,090,654 A * 2/1992 Ridings et al. ..... 248/343
5,206,464 A * 4/1993 Lamm et al. ..... 181/150
5,221,069 A * 6/1993 Struthers et al. ..... 248/231.9
5,423,500 A * 6/1995 Struthers et al. ..... 248/27.1
5,574,796 A * 11/1996 Keezer ..... 381/386
5,588,737 A * 12/1996 Kusmer ..... 362/148
5,690,423 A * 11/1997 Hentz et al. ..... 362/365
5,734,732 A * 3/1998 Lemmon ..... 381/386
5,845,886 A * 12/1998 McCormick ..... 248/200.1
5,954,304 A * 9/1999 Jorgensen ..... 248/200.1
5,957,574 A * 9/1999 Hentz et al. ..... 362/365
6,200,099 B1 * 3/2001 Liao ..... 416/244 R
6,283,430 B1 * 9/2001 Schubert et al. ..... 248/343
6,302,122 B1 * 10/2001 Parker et al. ..... 132/333
6,484,983 B1 * 11/2002 Combest ..... 248/220.1
6,488,097 B1 * 12/2002 MacDonald et al. ..... 169/43
6,578,808 B1 * 6/2003 Bertagni et al. ..... 248/343
6,758,451 B2 * 7/2004 Rivera et al. ..... 248/231.9
6,870,943 B2 * 3/2005 Liu ..... 381/395
7,234,674 B2 * 6/2007 Rippel et al. ..... 248/343
2003/0026445 A1 * 2/2003 Anderson ..... 381/386
2003/0031011 A1 * 2/2003 Miller et al. ..... 362/150
2003/0035563 A1 * 2/2003 Chen ..... 381/386
2003/0155473 A1 * 8/2003 Rivera et al. ..... 248/205.1
2003/0173483 A1 * 9/2003 Yeh ..... 248/287.1
2006/0113341 A1 * 6/2006 Murray et al. ..... 224/275
2006/0231326 A1 * 10/2006 Iwayama et al. ..... 181/150
2006/0243877 A1 * 11/2006 Rippel ..... 248/343
2006/0261235 A1 * 11/2006 Rippel et al. ..... 248/343

FOREIGN PATENT DOCUMENTS

JP 06141944 A * 5/1994
JP 08-023590 1/1996

* cited by examiner

MOUNTING SUPPORT DEVICE FOR CEILING EMBEDDED SPEAKER SYSTEM

The present application claims the benefit of priority of International Patent Application No. PCT/JP2004/000372 filed on Jan. 19, 2004, which application claims priority of Japanese Patent Application No. 2003-12100 filed Jan. 21, 2003. The entire text of the priority application is incorporated herein by reference in its entirety.

TECHNICAL FIELD

The present invention relates to an auxiliary device by which an in ceiling speaker system is mounted to a ceiling. More particularly, the present invention relates to an auxiliary device by which an in ceiling speaker system is firmly mounted to a ceiling even when a construction element is provided to protrude upward from a rear surface of the ceiling.

BACKGROUND ART

Some in ceiling speaker systems are mounted to a ceiling material in such a manner that the ceiling material is sandwiched and retained between retaining members. However, when the in ceiling speaker system has a heavy weight or the ceiling material is thin, it is not firmly mounted.

In order to achieve firm mounting and to prevent the in ceiling speaker system from falling off, an auxiliary mounting device is sometimes employed (e.g., see "Control Contractor Ceiling Loudspeakers Owner's Manual," "JBL Professional, page 7" "Bose Freespace Model 8 And Model 32 Loudspeakers Installer's Guide," by Bose Corporation, page 4 to 12, May 6, 2002").

FIG. 11 is a perspective view showing an example of such a auxiliary mounting device. This auxiliary mounting device 110 mainly comprises a ceiling pan 111, and a pair of support rails 121. The ceiling pan 111 is secured to the support rails 121 at a desired position in a longitudinal direction of the support rails 121.

FIG. 12 is a longitudinal sectional view showing a state in which an in ceiling speaker system 200 is mounted to a ceiling by using the auxiliary mounting device 110.

This ceiling structure is a drop ceiling structure employed in U.S. A ceiling material 131 is placed on a steel structure 130 having a T-shaped transverse cross-section, which is called T grid. The auxiliary mounting device 110 is placed on the ceiling material 131. An in ceiling speaker unit 200 is mounted through an opening formed in the ceiling material 131. The in ceiling speaker unit 200 includes a fixed retaining member 201 which is integral with a front panel and a movable retaining member 202 positioned behind the fixed retaining member 201. When a threaded member 203 is rotated to be fastened, the movable retaining member 202 moves downward, and the fixed retaining member 201 and the movable retaining member 202 sandwiches and retains the ceiling material 131 and the ceiling pan 111.

Since the ceiling pan 111 and the ceiling material 131 are sandwiched and retained together, the ceiling material 131 is not damaged if a large force is applied to sandwich and retain them. Therefore, the in ceiling speaker system 200 is firmly mounted to the ceiling. If the ceiling material 131 falls off from the steel structure 130 having the T-shaped cross-section for some reasons, the support rails 121 engage with the steel structure 130, so that the in ceiling speaker system 200 does not fall off.

There are various types of ceiling structures, other than the drop ceiling structure of FIG. 12. By way of example, there are ceiling structures in which construction elements 133 called a M bar shown in FIG. 13(*a*) or construction elements 136 called a C channel shown 13(*b*) are provided above the ceiling.

FIG. 13(*c*) is a longitudinal sectional view showing a state in which the auxiliary mounting device 110 of FIG. 11 is mounted to the ceiling structure in which the ceiling material 134 is threadedly engaged with the M bars 133 provided in parallel. As should be appreciated from FIG. 13(*c*), the construction elements (M bars) 133 protrude upward from the rear surface of the ceiling material 134, unlike the drop ceiling structure of FIG. 12. So, the ceiling pan 111 of the auxiliary mounting device 110 is distant from the rear surface of the ceiling member 134. When the in ceiling speaker system 200 of FIG. 12 is mounted to the ceiling, and the ceiling material 134 and the ceiling pan 111 are retained with a large force between the fixed retaining member 201 and the movable retaining member 202, the ceiling material 134 is likely to be damaged. As a result, the in ceiling speaker system 200 is not firmly mounted.

FIG. 13(*d*) is a longitudinal sectional view showing a state in which the auxiliary mounting device 110 is mounted to the ceiling structure in which the ceiling material 134 is threadedly engaged with the M bars 133 provided in parallel and a plurality of C channels 136 are provided on the M bars 133 to extend in a direction perpendicular to the M bars 133. As should be appreciated from FIG. 13(*d*), the construction elements (M bars 133 and C channels 136) protrude further upward from the rear surface of the ceiling material 134. Since ceiling pan 111 of the auxiliary mounting device 110 is more distant from the rear surface of the ceiling material 134, the in ceiling speaker system is not firmly mounted.

DISCLOSURE OF THE INVENTION

The present invention has been made in view of the above described problems, and an object of the present invention is to provide an auxiliary mounting device for an in ceiling speaker system which is capable of firmly mounting the in ceiling speaker system even in a ceiling structure in which a construction element protrudes upward from a rear surface of a ceiling material and of preventing the in ceiling speaker system from falling off.

In order to achieve the above described object, an auxiliary mounting device for an in ceiling speaker system, comprises a ceiling reinforcing element; and an elongate element, wherein the ceiling reinforcing element includes a flat plate portion provided horizontally on a rear surface of a ceiling plate and having an opening at a center portion thereof, and a vertical portion provided to extend vertically from the flat plate portion, the elongate element is provided to extend on a horizontal plane, the vertical portion is mounted to the elongate element such that the vertical portion is capable of being in a slidable state and in a fixed state, in the slidable state, the vertical portion is vertically slidable and displaceable with respect to the elongate element, and in the fixed state, the vertical portion is fixed to the elongate element so as not to vertically displace.

When this device is applied to the ceiling structure in which the construction element protrudes upward from the rear surface of the ceiling material, the vertical portion is configured to be slidable with the elongate element placed on the construction element. And, the vertical portion is vertically displaced to a position at which the flat plate portion contacts the rear surface of the ceiling material, and at that position, the vertical portion is fixed. Thereby, the elongate element is in contact with the upper side of the element, and the flat plate, portion is in contact with the rear surface of the ceiling material. As a result, it is possible to firmly mount the in ceiling speaker system to the ceiling and to prevent the in ceiling speaker system from falling off.

In the auxiliary mounting device for the in ceiling speaker system, the elongate element may be one of a pair of elongate elements, the vertical portion may be one of a pair of vertical portions which are provided to extend vertically from the flat plate portion at substantially opposite positions with the opening interposed between the pair of vertical portions, and the pair of elongate elements may be provided substantially in parallel with each other on the horizontal plane so as to respectively correspond to the pair of vertical portions. By providing the pair of elongate elements, a mounting condition is stabilized. In this case, since the pair of elongate elements have an identical structure, one type of elongate elements are manufactured. As a result, manufacturing cost can be reduced. In addition, since the auxiliary mounting device is mounted in the same mounting condition if the device is inverted 180 degrees within a horizontal plane, it is oriented more freely when mounted.

The auxiliary mounting device for the in ceiling speaker system may further comprise an intermediate element mounted to the elongate element, wherein the vertical portion may be capable of being in a slidable state in which the vertical portion is vertically slidable and displaceable with respect to the intermediate element and in a fixed state in which the vertical portion is fixed to the intermediate element so as not to vertically displace with respect to the intermediate element, and the vertical portion may be mounted to the elongate element with the intermediate element interposed between the vertical portion and the elongate element such that the vertical portion is capable of being in the slidable state and the fixed state.

In the auxiliary mounting device for the in ceiling speaker system, the intermediate element may be mounted to the elongate element such that the intermediate element is capable of being in a first state and in a second state with respect to the elongate element, in the first state, the intermediate element may be slidable and displaceable with respect to the elongate element in a longitudinal direction of the elongate element, and in the second state, the intermediate element may be fixed to the elongate element so as not to displace in the longitudinal direction of the elongate element. This makes it possible that the ceiling reinforcing element is provided at a desired position in the longitudinal direction of the elongate element.

In the auxiliary mounting device for the in ceiling speaker system, the intermediate element may include a first mounting portion by which the intermediate element is mounted to the elongate element, and a second mounting portion by which the vertical portion is mounted to the intermediate element, and the first mounting portion and the second mounting portion may be located at different positions in a vertical direction. In such a construction, the vertical position of the second mounting portion with respect to the elongate element can be varied between a case where the intermediate element is mounted to the elongate element such that the second mounting portion is located higher than the first mounting portion and a case where the intermediate element is mounted to the elongate element such that the second mounting portion is located lower than the first mounting portion. Therefore, the vertical position at which the ceiling reinforcing element is placed with respect to the elongate element is selected more freely. This makes it possible that the auxiliary mounting device is applicable to ceiling structures provided with the construction elements protruding upward with various dimensions.

In the auxiliary mounting device for the in ceiling speaker system, the elongate element may include a first flat portion extending in band shape in the longitudinal direction of the elongate element, a second flat portion located adjacent the first flat plate portion so as to extend in band shape in the longitudinal direction of the elongate element, and a third flat portion located adjacent the second flat portion so as to extend in band shape in the longitudinal direction of the elongate, the first flat portion, the second flat portion, and the third flat portion may form a substantially U-shape in a transverse cross-section of the elongate element, and the second flat portion may be provided with a mounting portion by which the intermediate element is mounted to the elongate element. In such a construction, the elongate element may be placed with the first flat portion or the third flat portion facing downward. Further, the vertical position of the second mounting portion of the intermediate element can be varied between a case where the first flat portion is caused to face downward with the intermediate element mounted to the elongate element and a case where the elongate element is vertically inverted to cause the third flat portion to face downward with the intermediate element mounted to the elongate element.

In the auxiliary mounting device for the in ceiling speaker system, in the slidable state, the vertical portion may be slidable and displaceable with respect to the elongate element in the longitudinal direction of the elongate element, and in the fixed state, the vertical portion may be fixed to the elongate element so as not to displace in the longitudinal direction of the elongate element.

These objects as well as other objects, features and advantages of the invention will become more apparent to those skilled in the art from the following description with reference to the accompanying drawings.

BRIEF DESCRIPTION OF THE DRAWINGS

FIG. 13(*b*) is a perspective view of the C channel; FIG. 13(*c*) is a longitudinal sectional view showing a state in which the auxiliary mounting device of FIG. 11 is placed in the ceiling structure in which a ceiling material is threadedly engaged with the M bars provided in parallel, and FIG. 13(*d*) is a longitudinal sectional view showing a state in which the ceiling material is threadedly engaged with the M bars provided in parallel and a plurality of C channels are provided on the M channels to extend in a direction perpendicular to the M bars.

BEST MODE FOR CARRYING OUT THE INVENTION

Embodiments of the present invention will be described with reference to the drawings. First of all, a auxiliary mounting device for an in ceiling speaker system according to an embodiment of the present invention will be described with reference to FIGS. 1 to 4.

Figure 1A:
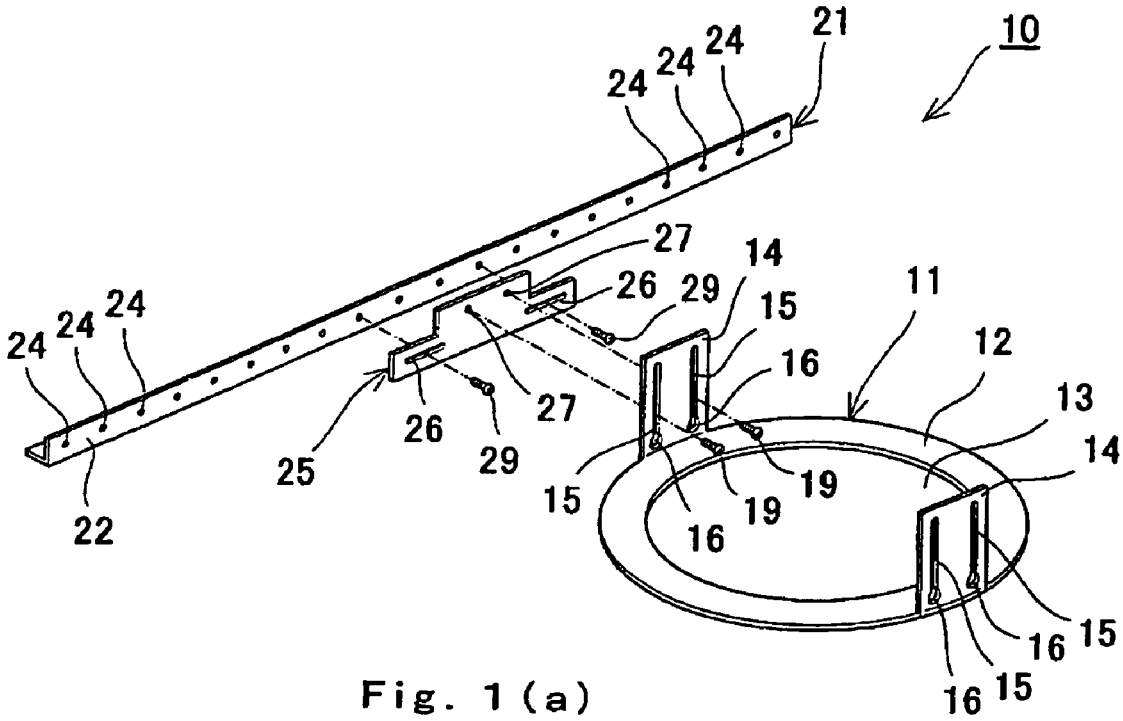
FIGS. 1(*a*) and 1(*b*) are views showing assembling of elements forming a auxiliary mounting device for an in ceiling speaker system, in which FIG. 1(*a*) is a view showing how to assemble a ceiling reinforcing element, an elongate element, and an intermediate element, and FIG. 1(*b*) is a view showing how to assemble the ceiling reinforcing element and the intermediate element.
Figure 1B:
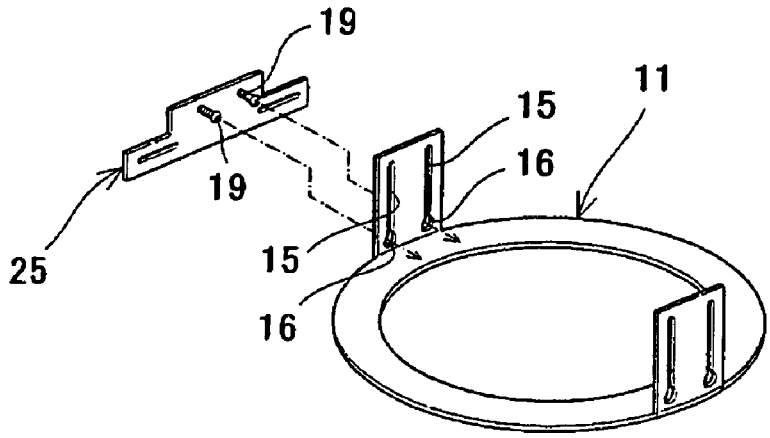

FIGS. 1(*a*) and 1(*b*) are views showing assembling of elements forming a auxiliary mounting device 10 for an in ceiling speaker system, in which FIG. 1(*a*) is a view showing how to assemble a ceiling reinforcing element 11, an elongate element 21, and an intermediate element 25, and FIG. 1(*b*) is a view showing how to assemble the ceiling reinforcing element 11 and the intermediate element 25.

The auxiliary mounting device 10 for the in ceiling speaker system mainly comprises one ceiling reinforcing element 11, a pair of elongate elements 21, and a pair of intermediate elements 25. In FIG. 1(*a*), one of the elongate elements 21 and one of the intermediate elements 25 are illustrated.

As shown in FIG. 1(*a*), the ceiling reinforcing element 11 includes a circular flat plate portion 12 and a pair of vertical portions 14 extending vertically upward from a peripheral edge of the flat plate portion 12. The vertical portions 14 extends to be substantially perpendicular to the flat plate portion 12. As shown in FIG. 1(*a*), the flat plate portion 12 is provided along a horizontal plane and the vertical portions 14 are provided along vertical planes. The flat plate portion 12 is circular and has an opening 13 at a center portion thereof. The vertical portions 12 are positioned substantially opposite to each other with the opening 13 interposed between them. Each vertical portion 14 has a pair of slit holes 15 extending vertically. The slit holes 15 have a substantially constant width over a substantially entire length and are provided with expanded portions 16 having a larger width at lower ends thereof.

The elongate element 21 is formed by a metal rod. The elongate element 21 has a L-shaped transverse cross-section. The elongate element 21 is provided with a plurality of mounting holes 24 arranged at constant intervals in a side surface 22 in a longitudinal direction of the elongate element 21. Female threaded portions are formed on inner peripheral surfaces of the mounting holes 24.

The intermediate element 25 is formed by a metal plate. The intermediate element 25 is provided with a pair of first mounting holes 26 which are first mounting portions and a pair of second mounting holes 27 which are second mounting portions. The first mounting holes 26 allow the intermediate element 25 to be thereby mounted to the elongate element 21, and are formed in the shape of slits extending horizontally. The second mounting holes 27 are positioned above the first mounting holes 26. The second mounting holes 27 allow the vertical portions 14 to be thereby mounted to the intermediate element 25. Female threaded portions are formed on inner peripheral surfaces of the mounting holes 27.

When the intermediate element 25 is mounted to the elongate element 21, bolts 29 are inserted through the first mounting holes 26 of the intermediate element 25 and then are threaded into the mounting holes 24 of the elongate element 21. The bolts 29 may be threaded into any of the plurality of mounting holes 24 of the elongate element 21. The length of the first mounting holes 26 (length of the slits) is larger than a spacing between adjacent mounting holes 24 of the plurality of mounting holes 24 formed in the elongate element 21.

Before fastening the bolts 29 with the bolts 29 inserted through the first mounting holes 26 of the intermediate element 25 and threaded into the mounting holes 24 of the elongate element 21, fine adjustment is made so that the intermediate element 25 is mounted to the elongate element 21 at a desired position, while sliding and displacing the intermediate element 25 in the longitudinal direction of the elongate element 21. After the intermediate element 25 is fixed at the desired position, the bolts 29 are fastened, thereby allowing the intermediate element 25 to be secured to the elongate element 21 not to displace in the longitudinal direction of the elongate element 21.

When the vertical portion 14 is mounted to the intermediate element 25, bolts 19 are inserted through the slit holes 15 of the vertical portion 14 and then are threaded into the second mounting holes 27 of the intermediate element 25. Before fastening the bolts 19 with the bolts 19 inserted through the slit holes 15 of the vertical portion 14 and threaded into the second mounting holes 27 of the intermediate element 25, fine adjustment is made so that the vertical portion 14 is mounted to the intermediate element 25 at a desired position, while sliding and displacing the vertical portion 14 vertically with respect to the intermediate element 25. After the vertical portion 14 is fixed at the desired position, the bolts 19 are fastened, thereby allowing the vertical portion 14 to be secured to the intermediate element 25 not to displace vertically.

In the manner described above, the intermediate element 25 is mounted to the elongate element 21 and the vertical portion 14 is mounted to the intermediate element 25. Since the length of the first mounting holes 26 (length of the slits) is larger than the spacing between the adjacent mounting holes 24 of the plurality of mounting holes 24 formed in the elongate element 21, the longitudinal position of the intermediate element 25 with respect to the elongate element 21 is determined as desired and is secured to the elongate element 21. In addition, the vertical position of the vertical portion 14 with respect to the intermediate element 25 is determined as desired and is secured to the intermediate element 25. Therefore, the ceiling reinforcing element 11 is positioned as desired with respect to the elongate element 21 both in the vertical direction and in the longitudinal direction of the elongate element 21, and is secured to the elongate element 21.

While in FIG. 1(*a*), the elongate element 21 and the intermediate element 25 that correspond to one of the pair of vertical portions 14 of the ceiling reinforcing element 11 is illustrated, an elongate element (not shown) and an intermediate element (not shown) are mounted to the other vertical portion 14 in the same manner. Thus, the pair of elongate elements 21 are provided substantially in parallel on a horizontal plane.

Alternatively, the vertical portion 14 may be mounted to the intermediate element 25 as shown in FIG. 1(*b*). First, the bolts 19 are threaded into the second mounting holes 27 of the intermediate element 25. The slit holes 15 of the vertical portion 14 are configured to have a width to enable heads of the bolts 19 to be inserted only through the expanded portions 16 at the lower ends thereof. Then, the heads of the bolts 19 are inserted through the expanded portions 16 of the slit holes 15. Then, fine adjustment is made so that the vertical portion 14 is mounted to the intermediate element 25 at a desired position while vertically sliding and displacing the vertical portion 14 with respect to the intermediate element 25. After the vertical portion 14 is fixed at the desired position, the bolts 19 are fastened, thereby allowing the vertical portion 14 to be secured to the intermediate element 25 so as not to displace vertically.

Figure 2A:
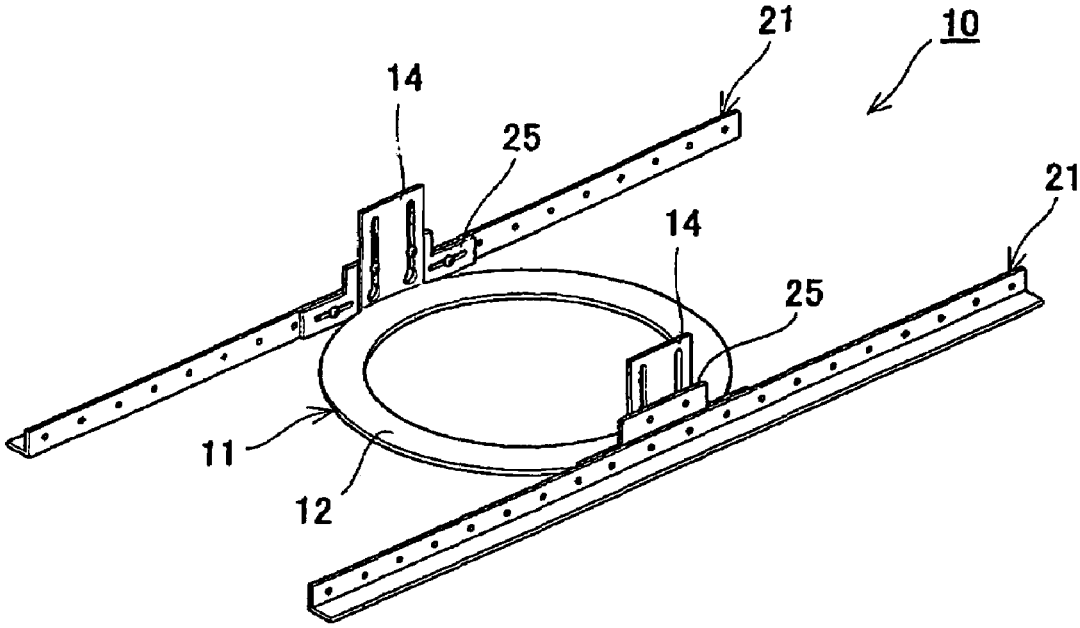
FIGS. 2(*a*) and 2(*b*) are views showing the auxiliary mounting device for the in ceiling speaker system, in which FIG. 2(*a*) is a perspective view of the auxiliary mounting device and FIG. 2(*b*) is a longitudinal sectional view showing the state in which the auxiliary mounting device is mounted to a ceiling.
Figure 2B:
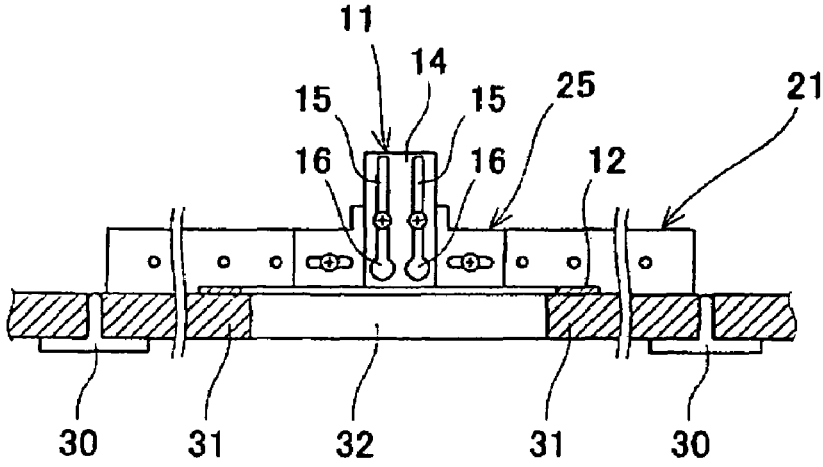

FIGS. 2(*a*) and 2(*b*) are views showing the auxiliary mounting device 10 for the in ceiling speaker system, in which FIG. 2(*a*) is a perspective view of the auxiliary mounting device 10 and FIG. 2(*b*) is a longitudinal sectional view showing the state in which the auxiliary mounting device 10 is mounted to the ceiling. As shown in FIGS. 2(*a*) and 2(*b*), the auxiliary mounting device 10 for the in ceiling speaker system is fixed such that a bottom surface of the flat plate portion 12 of the ceiling reinforcing element 11 is substantially as high as bottom surfaces of the elongate elements 21.

The ceiling structure of FIG. 2(*b*) is a drop ceiling structure employed in U.S. A ceiling material 31 is placed on the steel structure 30 having a T-shaped transverse cross-section which is called T grid, and the auxiliary mounting device 11 is placed on the ceiling material 31. The length of the elongate elements 21 is substantially equal to the width of the ceiling material 31, and the elongate elements 21 are placed such that portions of each elongate element 21 which are in the vicinity of both ends thereof are positioned on adjacent steel structures 30 having the T-shaped transverse cross-section. The in ceiling speaker unit (not shown) is mounted to the ceiling through an opening 32 formed in the ceiling material 31. Since the flat plate portion 12 of the ceiling reinforcing element 11 is in contact with the rear surface of the ceiling material 31, the ceiling material 31 is not damaged even when the ceiling material 31 and the flat plate portion 12 are sandwiched and retained with a large force by the in ceiling speaker unit mounted through the opening 32. As a result, the in ceiling speaker system is firmly mounted to the ceiling.

If the ceiling material 31 falls from the steel structure 30 having the T-shaped transverse cross-section for some reasons, the elongate element 21 fits into the steel structure 30, so that the in ceiling speaker system does not fall off.

Figure 3A:
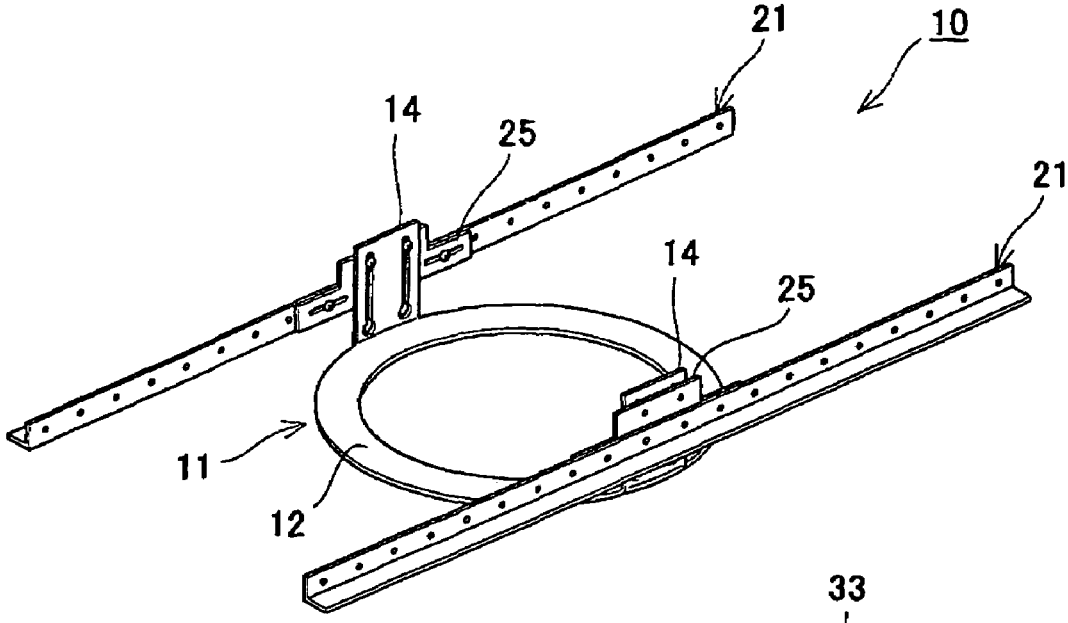
FIGS. 3(*a*) to 3(*c*) are views showing the auxiliary mounting device for the in ceiling speaker system, or the like, in which FIG. 3(*a*) is a perspective view of the auxiliary mounting device for the in ceiling speaker system, FIG. 3(*b*) is a longitudinal sectional view of the auxiliary mounting device for the in ceiling speaker system which is mounted to the ceiling, and FIG. 3(*c*) is a perspective view of a M bar.
Figure 3C:
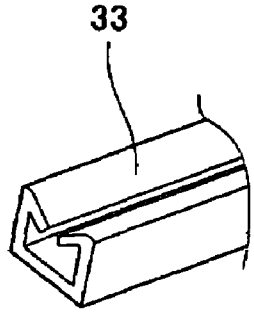
Figure 3B:
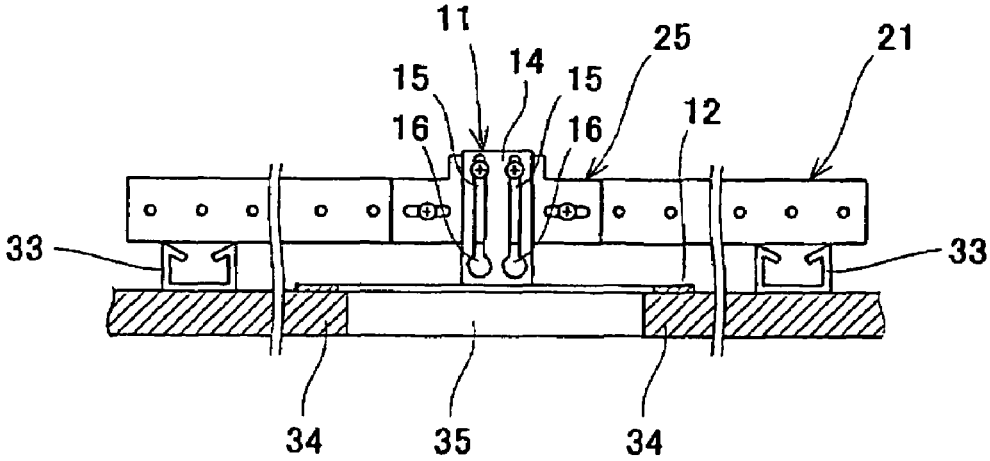
Figure 4A:
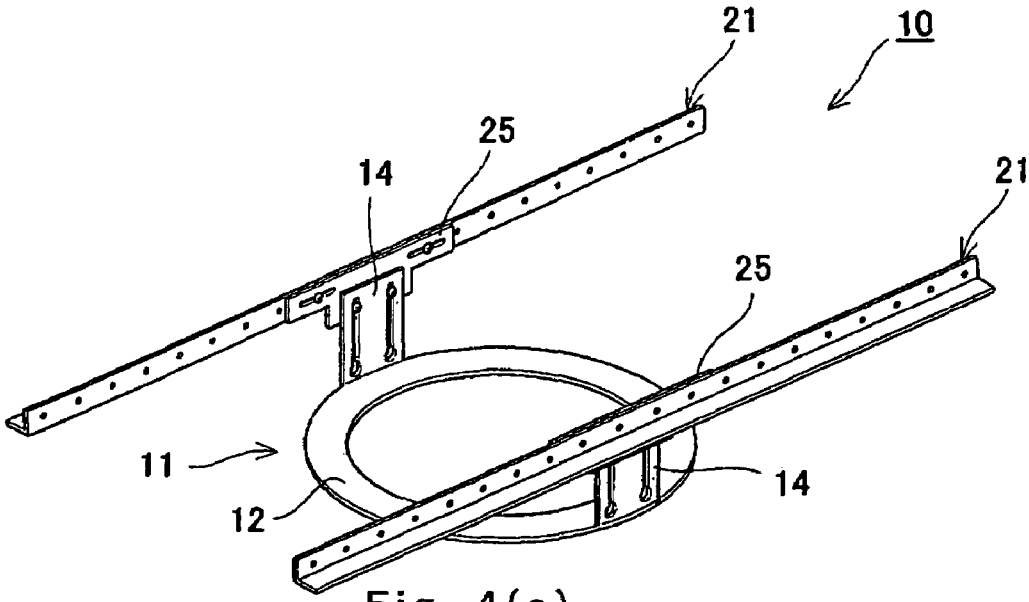
FIGS. 4(*a*) to 4(*c*) are views showing the auxiliary mounting device for the in ceiling speaker system, or the like, in which FIG. 4(*a*) is a perspective view of the auxiliary mounting device for the in ceiling speaker system, FIG. 4(*b*) is a longitudinal sectional view of the auxiliary mounting device for the in ceiling speaker system which is mounted to the ceiling, FIG. 4(*c*) is a perspective view of the M bar, and FIG. 4(*d*) is a perspective view of a C channel.
Figure 4B:
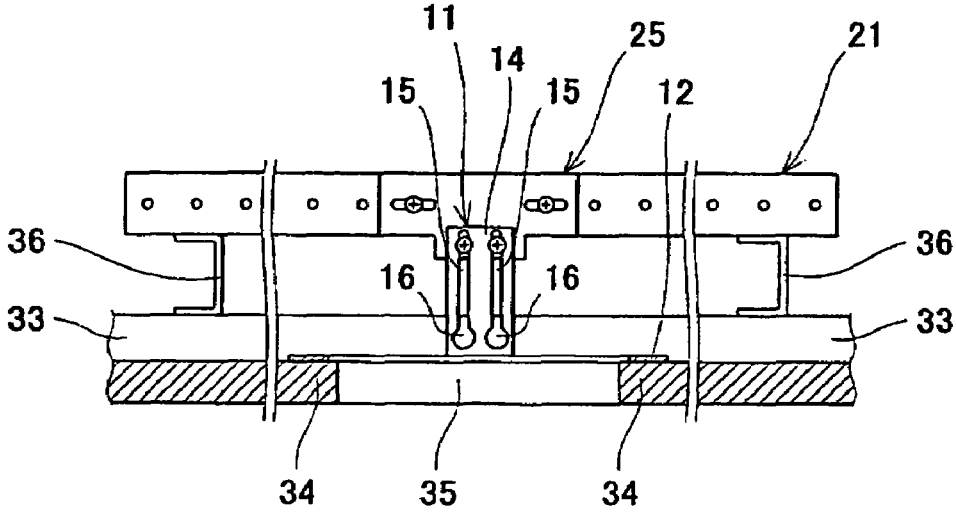
Figure 4C:
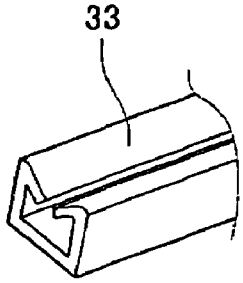
Figure 4D:
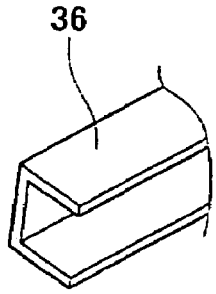

FIGS. 3(*a*) to 3(*c*) are views showing the auxiliary mounting device 10 for the in ceiling speaker system or the like, in which FIG. 3(*a*) is a perspective view of the auxiliary mounting device 10 for the in ceiling speaker system, FIG. 3(*b*) is a longitudinal sectional view of the auxiliary mounting device 10 for the in ceiling speaker system which is mounted to the ceiling, and FIG. 3(*c*) is a perspective view of a M bar 33. As shown in FIGS. 3(*a*) and 3(*b*), the flat plate portion 12 of the ceiling reinforcing element 11 is fixed such that the bottom surface thereof is located below a bottom surfaces of the elongate elements 21.

The ceiling structure of FIG. 3(*b*) is typically employed in Japan. The M bars 33 of FIG. 3(*c*) are provided in parallel above the ceiling and the ceiling material 34 is threadedly engaged with the M bars 33. As can be seen from FIG. 3(*b*), in this ceiling structure, the construction elements (M bars) 33 protrude upward from the rear surface of the ceiling material 34. The elongate elements 21 of the auxiliary mounting device 10 for the in ceiling speaker system are placed such that portions of each elongate element 21 which are in the vicinity of both ends thereof are in contact with upper sides of the adjacent M bars 33. The flat plate portion 12 of the ceiling reinforcing element 11 is placed in contact with the rear surface of the ceiling material 34. The in ceiling speaker unit (not shown) is mounted to the ceiling through an opening 35 formed in the ceiling material 34, and sandwiches and retains the ceiling material 34 and the flat plate portion 12. As described above, since the flat plate portion 12 is in contact with the rear surface of the ceiling material 34, the ceiling material 34 is not damaged even when the ceiling material 34 and the flat plate portion 12 are sandwiched and retained with a large force. As a result, the in ceiling speaker system is firmly mounted to the ceiling.

In addition, since the portions of each elongate element 21 which are in the vicinity of both ends thereof are placed in contact with the upper sides of the M bars 33, the M bars 33 are subjected to a load of the in ceiling speaker system, and an excess load is not applied to the ceiling material 34.

If the ceiling material 34 falls off from the M bars 33 for some reasons, the elongate elements 21 engage with the M bars 33, so that the in ceiling speaker system does not fall off.

FIGS. 4(*a*) to 4(*d*) are views showing the auxiliary mounting device 10 for the in ceiling speaker system or the like, in which FIG. 4(*a*) is a perspective view of the auxiliary mounting device 10 for the in ceiling speaker system, FIG. 4(*b*) is a longitudinal sectional view of the auxiliary mounting device 10 for the in ceiling speaker system which is mounted to the ceiling, FIG. 4(*c*) is a perspective view of the M bar 33, and FIG. 4(*d*) is a perspective view of a C channel 36. In the auxiliary mounting device 10 for the in ceiling speaker system of FIGS. 4(*a*) and 4(*b*), the bottom surface of the flat plate portion 12 of the ceiling reinforcing element 11 is located lower than that of FIGS. 3(*a*) and 3(*b*) with respect to the bottom surfaces of the elongate elements 21. In order to enable the flat plate portion 12 of the ceiling reinforcing element 11 to be positioned lower, the intermediate element 25 is mounted to the elongate element 21 to be oriented in a direction different from that shown in FIGS. 3(*a*) and 3(*b*). More specifically, the intermediate element 25 is oriented in a vertically opposite direction. Thereby, in the construction of FIG. 4(*a*) and 4(*b*), the second mounting holes 27 of the intermediate element 25 are located lower than those of FIGS. 3(*a*) and 3(*b*) with respect to the elongate element 21, and as a result, the flat plate portion 12 of the ceiling reinforcing element 11 is fixed to the elongate element 21 at a lower position.

The ceiling structure of FIG. 4(*b*) is typically employed in Japan. The M bars 33 of FIG. 4(*c*) are provided in parallel above the ceiling, the ceiling material 34 is threadedly engaged with the M bars 33, and a plurality of C channels 36 of FIG. 4(*d*) are provided on the M bars 33 to extend in the direction perpendicular to the M bars 33.

As can be seen from FIG. 4(*b*), construction elements (construction elements formed by the M bars 33 and the C channels 36) protrude upward further than those shown in FIG. 3(*b*). The elongate elements 21 of the auxiliary mounting device 10 for the in ceiling speaker system are placed such that portions of each elongate element 21 which are in the vicinity of both ends are in contact with upper sides of adjacent C channels, and the flat plate portion 12 is in contact with the rear surface of the ceiling material 34. The in ceiling speaker unit (not shown) is mounted through the opening 35 formed in the ceiling material 34, and sandwiches and retains the ceiling material 34 and the flat plate portion 12. As described above, since the flat plate portion 12 is in contact with the rear surface of the ceiling material 34, the ceiling material 34 is not damaged even when the ceiling material 34 and the flat plate portion 12 are sandwiched and retained with a large force. As a result, the in ceiling speaker system can be firmly mounted to the ceiling.

Since the portions of each elongate element 21 which are in the vicinity of both ends thereof are placed in contact with the upper sides of the C channels 36, the M bars 33 and the C channels 36 are subjected to the load of the in ceiling speaker system, and an excess load is not applied to the ceiling material 34.

If the ceiling material 34 falls off the construction elements formed by the M bars 33 and the C channels 36 for some reasons, the elongate elements 21 engage with the C channels 36, so that the in ceiling speaker system does not fall off.

The auxiliary mounting device 10 for the in ceiling speaker system described with reference to FIGS. 1 to 4 is constructed such that the pair of elongate elements 21 and the pair of vertical portions 14 are substantially symmetric. This stabilizes a mounting condition of the auxiliary mounting device 10 for the in ceiling speaker system. Since the pair of elongate elements 21 have an identical structure, a manufacturing cost can be reduced by manufacturing one type of elongate elements. Furthermore, since the auxiliary mounting device 10 for the in ceiling speaker system is mounted in the same mounting condition if the device 10 is inverted 180 degrees within a horizontal plane, it is oriented more freely when mounted.

So far, one embodiment of the auxiliary mounting device for the in ceiling speaker system according to the present invention has been described with reference FIGS. 1 to 4.

Subsequently, various embodiments of the present invention will be described with reference FIGS. 5 to 9.

Figure 5A:
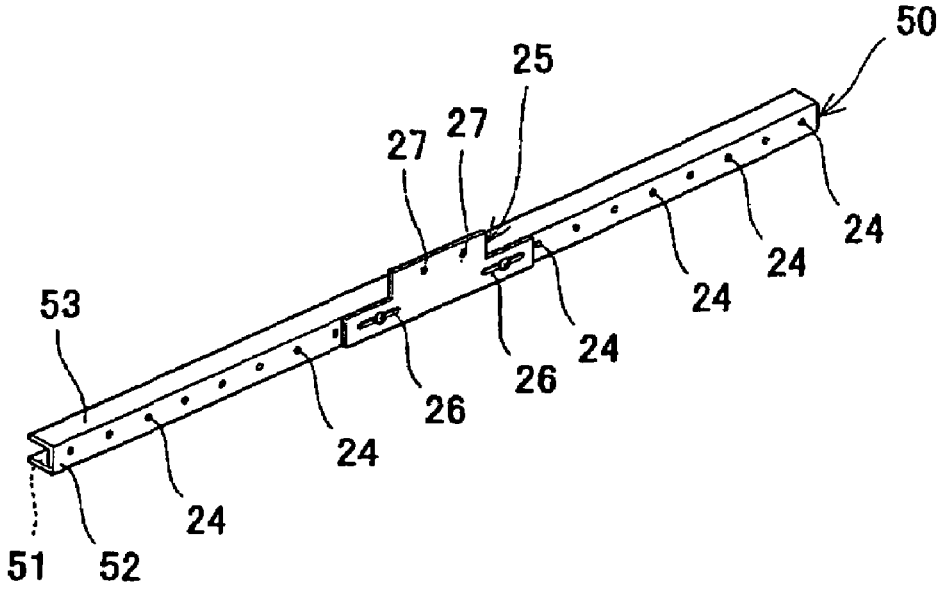
FIG. 5(*a*) is a perspective view of an elongate element with an intermediate element mounted thereto and FIGS. 5(*b*) and 5(*c*) are side views of the elongate element with the intermediate element mounted thereto.
Figure 5B:
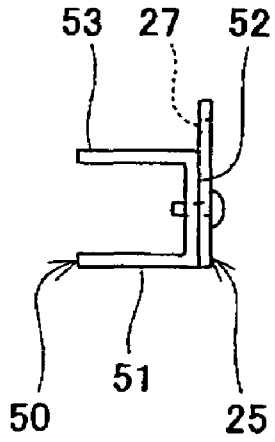
Figure 5C:
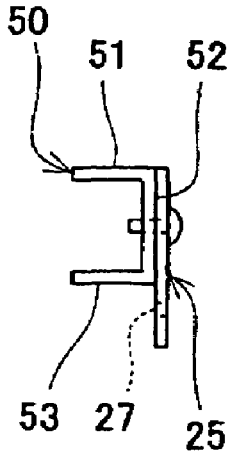

FIG. 5(*a*) is a perspective view of an elongate element 50 with the intermediate element 25 mounted thereto and FIGS. 5(*b*) and 5(*c*) are side views of the elongate element 50 with the intermediate element 25 mounted thereto. Unlike the elongate element 21 of FIG. 1 which has a L-shaped transverse cross-section, the elongate element 50 of FIGS. 5(*a*) to 5(*c*) has a substantially U-shaped transverse cross-section. As can be seen from FIGS. 5(*a*) to 5(*c*), the elongate element 50 has a bottom surface 51 which is a first flat portion, a side surface 52 which is a second flat portion, and a top surface 53 which is a third flat portion. Each of the bottom surface 51, the side surface 52, and the top surface 53 faces outward and extends in band shape in a longitudinal direction of the elongate element 50. The bottom surface 51 is located adjacent the side surface 52 and the top surface 53 is located adjacent the side surface 52. The bottom surface 51, the side surface 52, and the top surface 53 form a substantially U-shape in the transverse cross-section of the elongate element 50. As in the elongate element 21 of FIG. 1, a plurality of mounting holes 24 are formed at constant intervals in the side surface 52 of the elongate element 50 and serve as mounting portions by which the intermediate element 25 is mounted to the elongate element 50. Female threaded portions are formed on the inner peripheral surfaces of the mounting holes 24.

When the elongate element 50 is placed above the ceiling with the intermediate element 25 mounted to the elongate element 50 as shown in FIG. 5(*a*) and the bottom surface 51 facing downward, the second mounting holes 27 of the intermediate element 25 are located above the elongate element 50, as shown in the side view of FIG. 5(*b*). Meanwhile, when the elongate element 50 is placed above the ceiling with the intermediate element 25 mounted to the elongate element 50 as shown in FIG. 5(*a*) and the top surface 53 facing downward, the second mounting holes 27 of the intermediate element 25 are located below the elongate element 50, as shown in the side view of FIG. 5(*c*).

By placing the elongate element 50 above the ceiling with the top surface 53 facing downward as shown in FIG. 5(*c*), the ceiling reinforcing element (not shown) is located lower with respect to the elongate element 50. Such a construction is applicable to a ceiling structure in which the construction elements protrude upward greatly from the rear surface of the ceiling material.

By merely selecting whether the bottom surface 51 or the top surface 53 faces downward with the intermediate element 25 mounted to the elongate element 50 as shown in FIG. 5(*a*), the vertical position of the second mounting holes 27 of the intermediate element 25 with respect to the elongate element 50 can be greatly changed. It becomes therefore unnecessary to remove the intermediate element 25 from the elongate element 50 and to re-mount the intermediate element 25 to the elongate element 50 with the intermediate element 25 oriented in a vertically opposite direction.

So far, another embodiment of the present invention has been described with reference to FIG. 5.

Subsequently, another embodiment of the present invention will be described with reference to FIG. 6.

Figure 6:
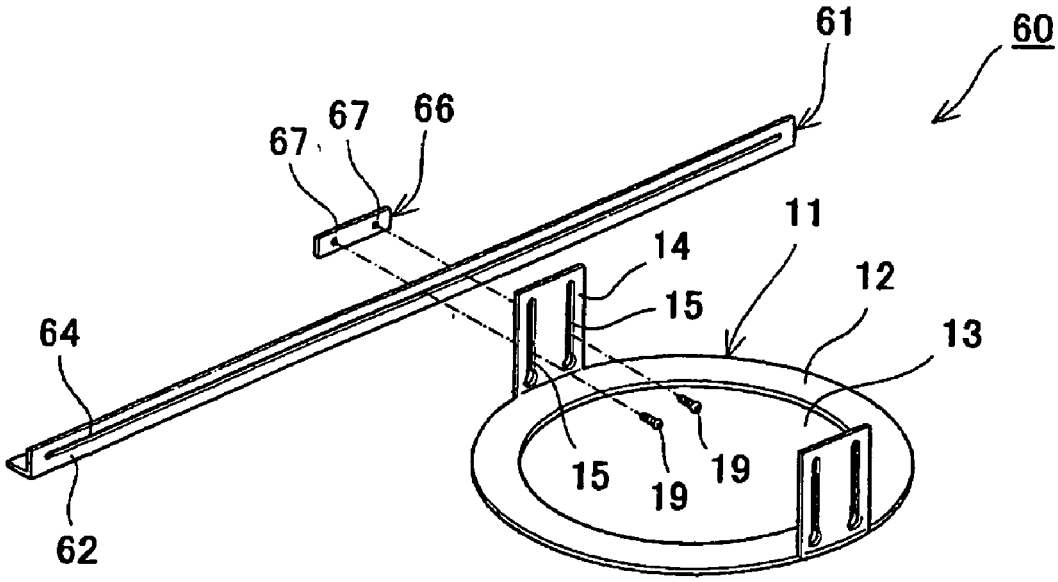
FIG. 6 is a view showing assembling of elements forming the auxiliary mounting device for the in ceiling speaker system.

FIG. 6 is a view showing assembling of elements (ceiling reinforcing element 11, elongate element 61) forming an auxiliary mounting device 60 for an in ceiling speaker system.

The ceiling reinforcing element 11 of the auxiliary mounting device 60 for the in ceiling speaker system is identical in structure to the ceiling reinforcing element 11 of FIG. 1.

The elongate element 61 is formed by a metal rod and has a L-shaped transverse cross-section. A mounting hole 64 formed in a side surface 62 of the elongate element 61 is a slit hole extending in a longitudinal direction of the elongate element 61.

A plate 66 is provided with two holes 67 formed therein, and female threaded portions are formed on the inner peripheral surfaces of these holes 67.

The ceiling reinforcing element 11 is mounted to the elongate element 61 in such a manner that the bolts 19 are inserted through the slit holes 15 of the vertical portion 14 of the ceiling reinforcing element 11 and the mounting hole (slit hole) 64 of the elongate element 61 and then is threadedly engaged with the plate 66. With the bolts 19 threadedly engaged with the plate 61 without being tightly fastened, the vertical portion 14 is slidable and displaceable with respect to the elongate element 61 in the longitudinal direction of the elongate element 61 or in the vertical direction. Therefore, fine adjustment is made so that the vertical portion 14 is mounted to the elongate element 61 at a desired position both in the longitudinal direction of the elongate element 61 and in the vertical direction. After the vertical portion 14 is fixed at the desired position, the bolts 19 are fastened, thereby allowing the vertical portion 14 to be secured to the elongate element 61 so as not to displace both in the longitudinal direction of the elongate element 61 and in the vertical direction.

While in FIG. 6, only one of the elongate elements 61 corresponding to one of the pair of vertical portions 14 formed on the ceiling reinforcing element 11 is illustrated, an identical elongate element is mounted to the other vertical portion 14 in the same manner.

So far, another embodiment of the present invention has been described with reference to FIG. 6.

Subsequently, another embodiment of the present invention will be described with reference to FIG. 7.

Figure 7:
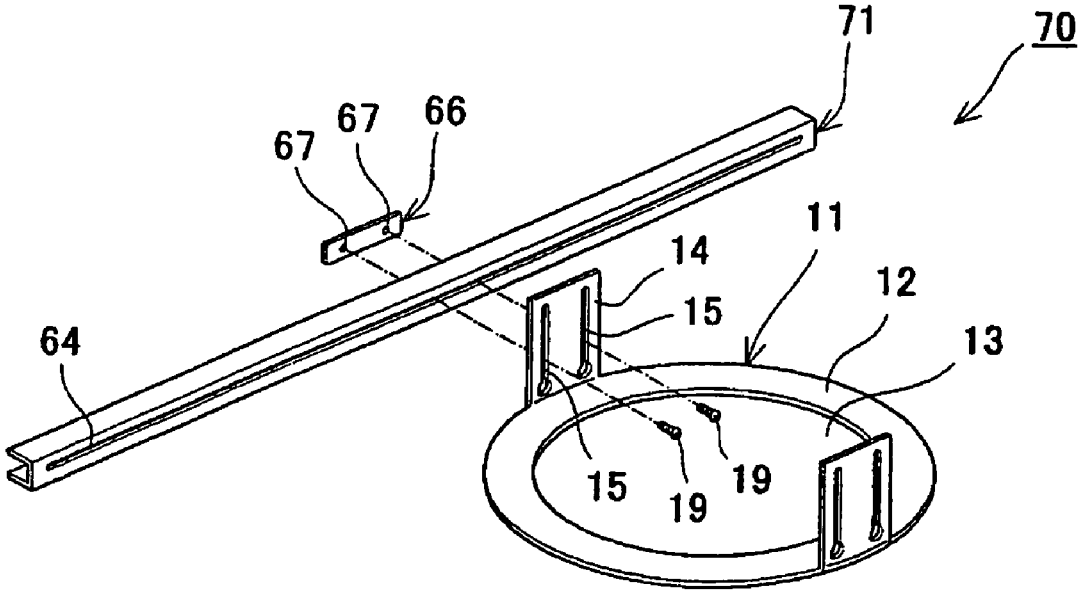
FIG. 7 is a view showing assembling of elements forming the auxiliary mounting device for the in ceiling speaker system.

FIG. 7 is a view showing assembling of elements (ceiling reinforcing element 11, elongate element 71) forming an auxiliary mounting device 70 for an in ceiling speaker system.

The auxiliary mounting device 70 for the in ceiling speaker system is substantially identical to the auxiliary mounting device 60 for the in ceiling speaker system of FIG. 6, except for the shape of the elongate element. Specifically, while the elongate element 61 of the auxiliary mounting device 60 for the in ceiling speaker system of FIG. 6 has the L-shaped transverse cross-section, an elongate element 71 of the auxiliary mounting device 70 for the in ceiling speaker system of FIG. 7 has a substantially U-shaped transverse cross-section. In the auxiliary mounting device 70 for the in ceiling speaker system of FIG. 7, the plate 66 internally fits into the elongate element 71.

While in FIG. 7, only one of the elongate elements 71 corresponding to one of the pair of vertical portions 14 formed on the ceiling reinforcing element 11 is illustrated, the elongate element is mounted to the other vertical portion 14 in the same manner.

So far, another embodiment of the present invention has been described with reference to FIG. 7.

Subsequently, another embodiment of the present invention will be described with reference to FIG. 8.

Figure 8:
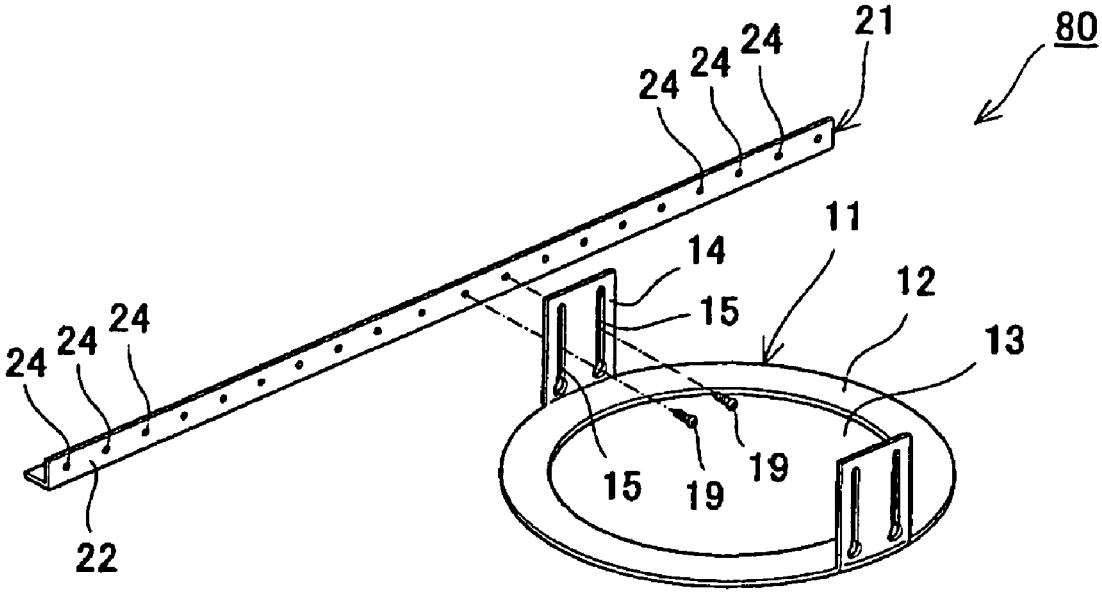
FIG. 8 is a view showing assembling of elements forming the auxiliary mounting device for the in ceiling speaker system.

FIG. 8 is a view showing assembling of elements (ceiling reinforcing element 11, elongate element 21) forming an auxiliary mounting device 80 for an in ceiling speaker system.

The ceiling reinforcing element 11 and the elongate element 21 of the auxiliary mounting device 80 for the in ceiling speaker system are identical in structure to the ceiling reinforcing element 11 and the elongate element 21 of FIG. 1. But, the auxiliary mounting device 80 for the in ceiling speaker system of FIG. 8 is not provided with an intermediate element, unlike the auxiliary mounting device 10 for the in ceiling speaker system of FIG. 1.

The ceiling reinforcing element 11 is mounted to the elongate element 21 in such a manner that the bolts 19 are inserted through the slit holes 15 of the vertical portion 14 of the ceiling reinforcing element 11 and then are threaded into the mounting holes 24 (holes having female threaded portions on the inner peripheral surfaces thereof of the elongate element 21. With the bolts 19 threadedly engaged with the elongate element 21 without being tightly fastened, the vertical portion 14 is vertically slidable and displaceable with respect to the elongate element 21. Therefore, fine adjustment is made so that the vertical portion 14 is mounted to the elongate element 21 at a desired position in the vertical direction. After the vertical portion 14 is fixed at the desired position, the bolts 19 are fastened, thereby allowing the vertical portion 14 to be secured to the elongate element 21 so as not to vertically displace with respect to the elongate element 21.

Although the auxiliary mounting device 80 for the in ceiling speaker system is incapable of finely adjusting the position of the vertical portion 14 in the longitudinal direction of the elongate element 21, it is capable of positioning the vertical portion 14 in the longitudinal direction of the elongate element 21 for each spacing between the adjacent mounting holes 24 of the plurality of mounting holes 24 formed in the elongate element 21.

While in FIG. 8, only one of the elongate elements 21 corresponding to one of the pair of vertical portions 14 formed on the ceiling reinforcing element 11 is illustrated, an identical elongate element is mounted to the other vertical portion 14 in the same manner.

So far, another embodiment of the present invention has been described with reference to FIG. 8.

Subsequently, another embodiment of the present invention will be described with reference to FIG. 9.

Figure 9:
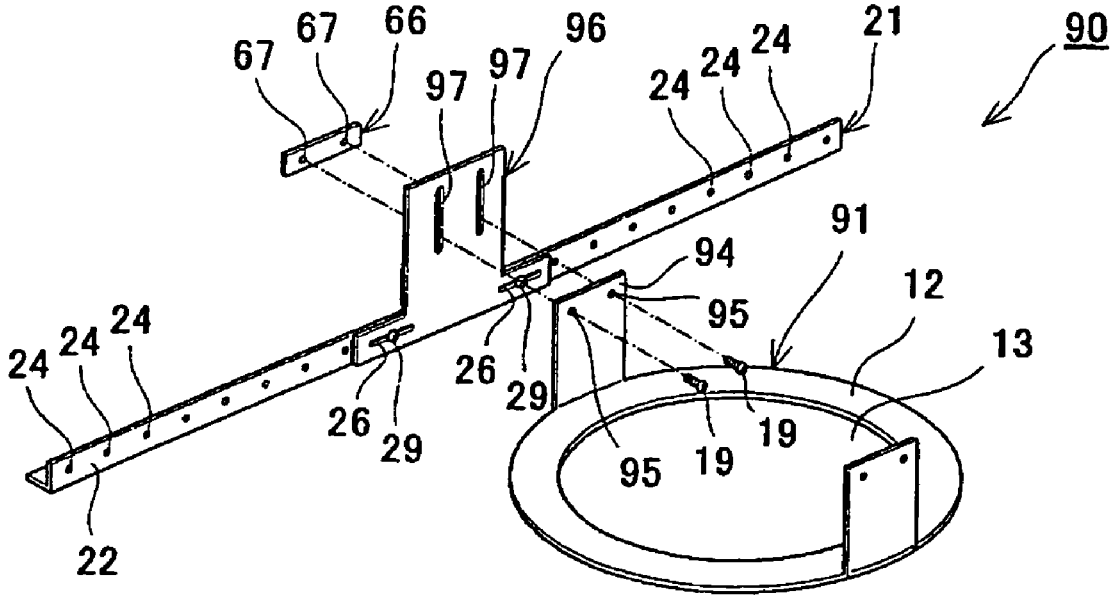
FIG. 9 is a view showing assembling of elements forming the auxiliary mounting device for the in ceiling speaker system.

FIG. 9 is a view showing assembling of elements (ceiling reinforcing element 91, elongate element 21, intermediate element 96) forming an auxiliary mounting device 90 for the in ceiling speaker system.

The ceiling reinforcing element 91 of the auxiliary mounting device 90 for the in ceiling speaker system is identical to the ceiling reinforcing element 11 of FIG. I except that a vertical portion 94 is not provided with slit holes but with circular holes 95 having a diameter slightly larger than that of shafts of the bolts 19.

The elongate element 21 of the auxiliary mounting device 90 for the in ceiling speaker system is identical in structure to the elongate element 21 of FIG. 1.

The intermediate element 96 of the auxiliary mounting device 90 for the in ceiling speaker system is identical to the intermediate element 25 of FIG. 1 except that the second mounting holes 97 which are second mounting portions formed in the intermediate element 96 are slit holes extending in the vertical direction.

The plate 66 is identical in structure to the plate 66 of FIG. 6.

The ceiling reinforcing element 91 is mounted to the elongate element 21 in such a manner that the intermediate element 96 is mounted to the elongate element 21 by the bolts 29, and the bolts 19 are inserted through the circular holes 95 of the vertical portion 94 of the ceiling reinforcing element 91 and the second mounting holes (slit holes) 97 of the intermediate element 96 and are threadedly engaged with the plate 66.

With the bolts 19 threadedly engaged with the plate 66 without being tightly fastened, the vertical portion 94 is vertically slidable and displaceable with respect to the elongate element 21. Therefore, fine adjustment is made so that the vertical portion 94 is mounted to the elongate element 21 at a desired position in the vertical direction. After the vertical portion 94 is fixed at the desired position, the bolts 19 are fastened, thereby allowing vertical portion 94 to be secured to the elongate element 21 so as not to vertically displace.

While in FIG. 9, only one of the elongate elements 21 corresponding to one of the pair of vertical portions 94 formed on the ceiling reinforcing element 91 is illustrated, an identical elongate element is mounted to the other vertical portion 94 in the same manner.

So far, another embodiment of the present invention has been described with reference to FIG. 9.

Figure 10A:
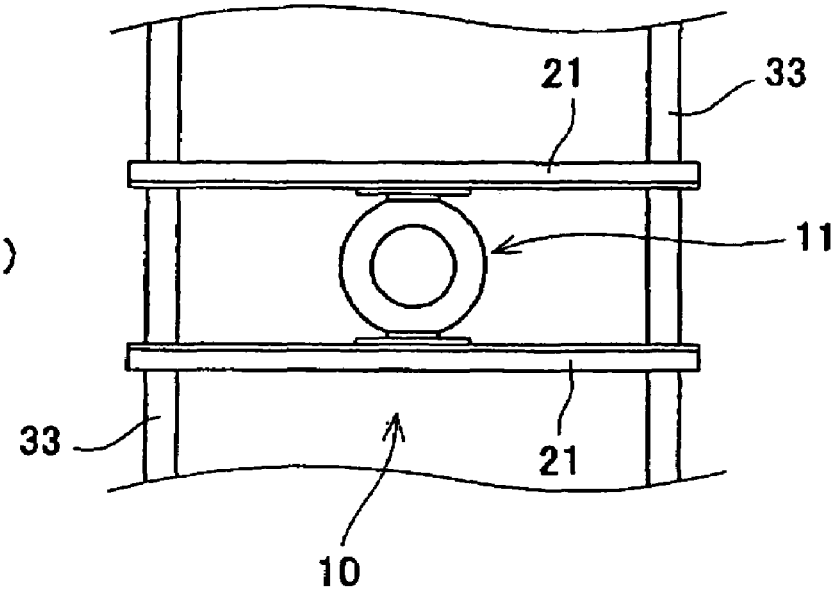
FIGS. 10(*a*) and 10(*b*) are plan views of the auxiliary mounting device for the in ceiling speaker system mounted above the ceiling, in which FIG. 10(*a*) is a view showing an arrangement configuration in which the elongate elements are slightly longer than a spacing between M bars, and FIG. 10(*b*) is a view showing an arrangement configuration in which the elongate elements are much longer than the spacing between the M bars.
Figure 10B:
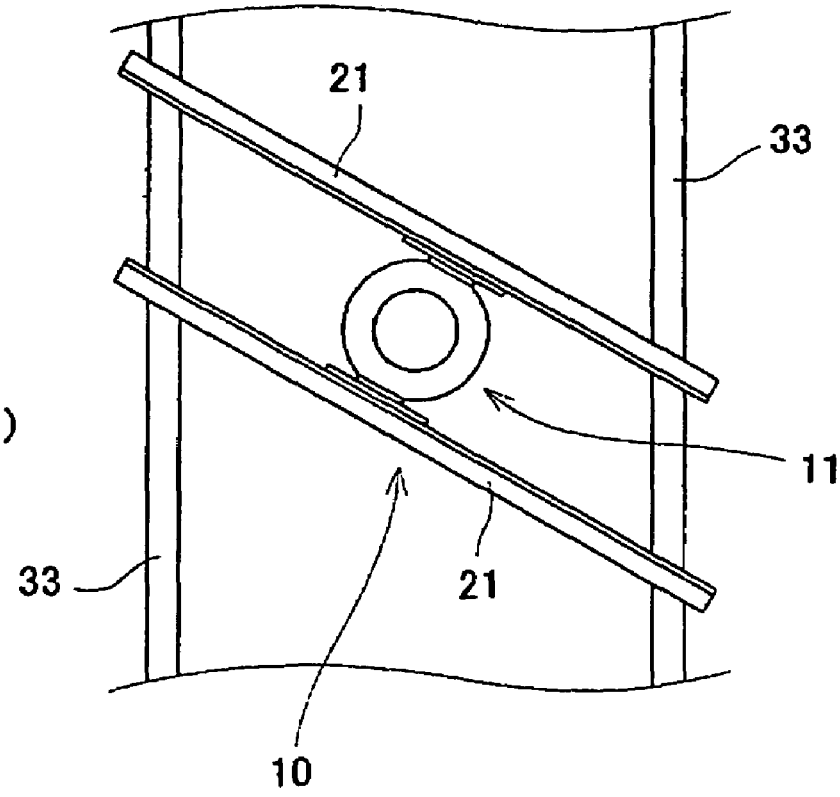
Figure 11:
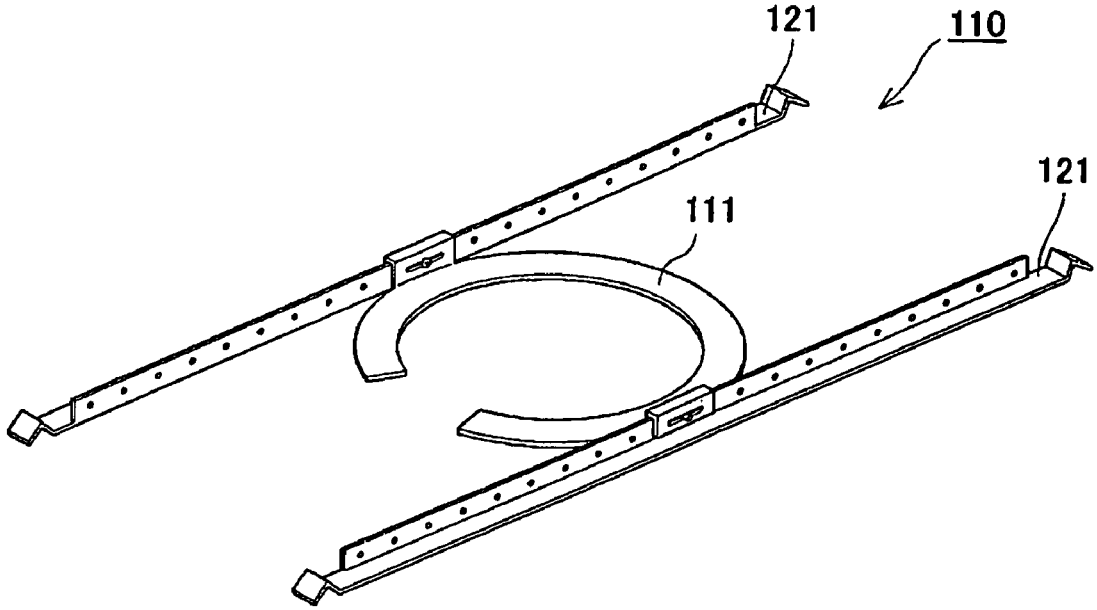
FIG. 11 is a perspective view showing a conventional auxiliary mounting device.
Figure 12:
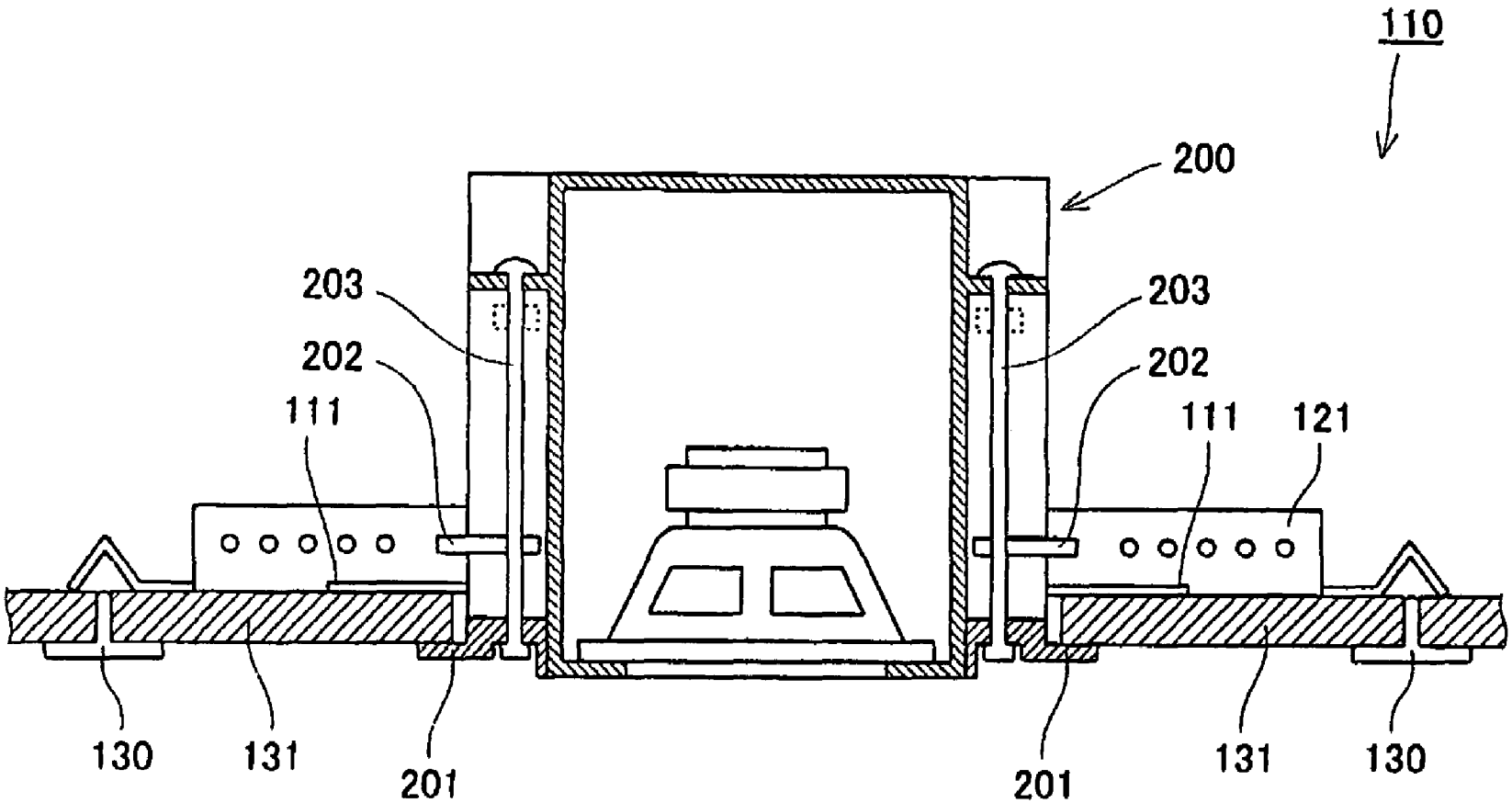
FIG. 12 is a longitudinal sectional view showing a state in which the in ceiling speaker system is mounted to the ceiling using the auxiliary mounting device of FIG. 11.
Figure 13A:
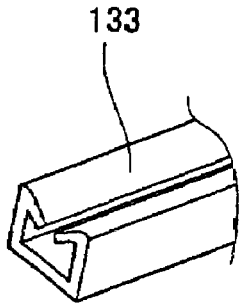
FIGS. 13(*a*) to 13(*d*) are views showing a state in which the auxiliary mounting device of FIG. 11 is applied to the ceilings of various structures, in which FIG. 13(*a*) is a perspective view of the M bar.
Figure 13B:
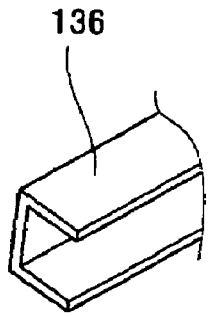
Figure 13C:
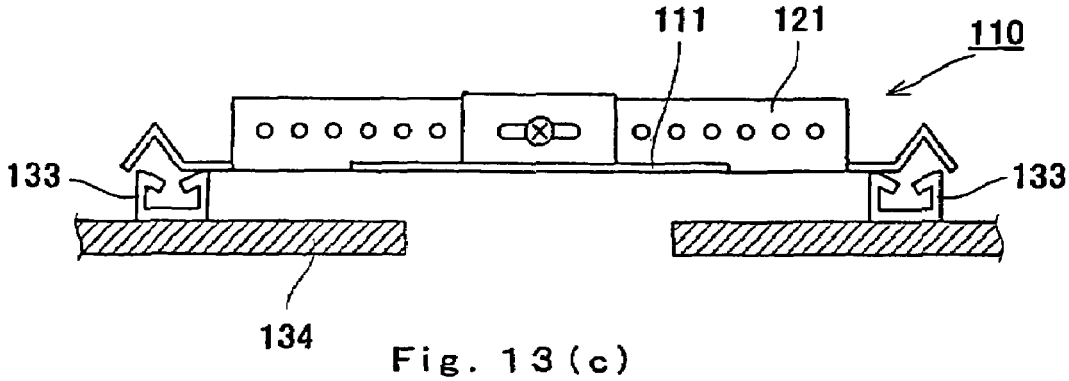
Figure 13D:
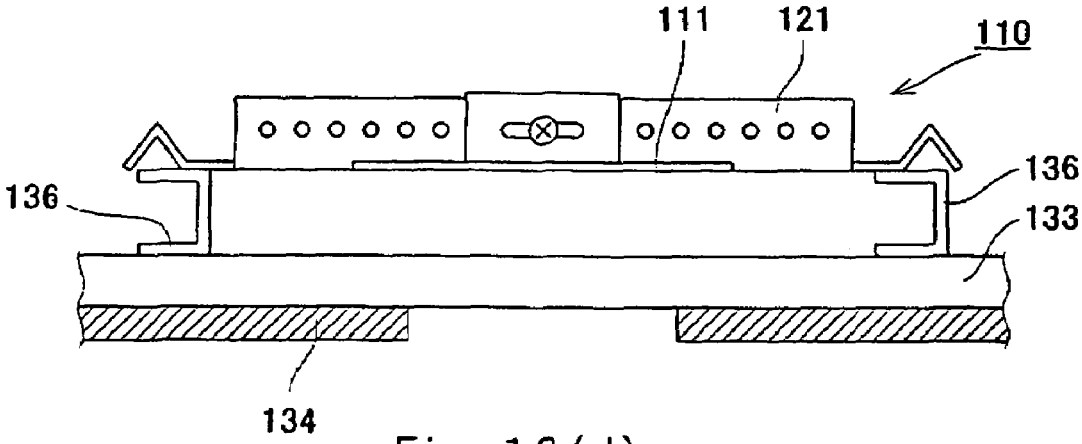

Subsequently, a planar placement configuration of the auxiliary mounting device for the in ceiling speaker system above the ceiling will be described with reference to FIG. 10. FIGS. 10(*a*) and 10(*b*) are plan views of the auxiliary mounting device 10 for the in ceiling speaker system mounted above the ceiling, in which FIG. 10(*a*) is a view showing an arrangement configuration in which the elongate elements 21 are slightly longer than a spacing between the M bars 33, and FIG. 10(*b*) is a view showing an arrangement configuration in which the elongate elements 21 are much longer than the spacing between the M bars 33.

The auxiliary mounting device 10 for the in ceiling speaker system of FIG. 10 is identical to the auxiliary mounting device 10 for the in ceiling speaker system of FIG. 1. The ceiling structure to which the auxiliary mounting device 10 for the in ceiling speaker system is identical to the ceiling structure of FIG. 3(*b*).

With reference to FIG. 10(*a*), the M bars 33 are provided in parallel with each other above the ceiling, and the elongate elements 21 are placed in contact with the upper sides of the M bars 33. The length of the elongate elements 21 is slightly larger than the spacing between the M bars 33 so that the portions of each elongate element 21 which are in the vicinity of both ends thereof are in contact with the upper sides of the M bars 33.

When the length of the elongate element 21 is thus slightly larger than the spacing between the M bars 33, the portions of each elongate element 21 which are in the vicinity of both ends thereof are configured to be in contact with the upper sides of the M bars 33, by placing the elongate elements 21 to extend in the direction perpendicular to the M bars 33. On the other hand, when the length of the elongate elements 21 is much larger than the spacing between the M bars 33, the elongate elements 21 protrude greatly from the M bars 33 if the elongate elements 21 are placed to extend in the direction perpendicular to the M bars 33. In this case, if another device (e.g., lighting device) is placed above the ceiling, the elongate elements 21 interfere with the device. To avoid such a situation, the elongate elements 21 are placed as shown in FIG. 10(*b*).

With reference to FIG. 10(*b*), the M bars 33 are provided in parallel with each other above the ceiling, and the elongate elements 21 are placed in contact with the upper sides of the M bars 33. The length of the elongate elements 21 is much larger than the spacing between the M bars 33. Accordingly, by placing the elongate elements 21 obliquely with respect to the M bars 33, the elongate elements 21 are provided so as not to protrude greatly from the M bars 33.

It shall be appreciated that the difference between the state in FIG. 10(*a*) and the state in FIG. 10(*b*) is the position of the ceiling reinforcing element 11 in the longitudinal direction of the elongate element 21.

So far, the planar arrangement configuration of the auxiliary mounting device for the in ceiling speaker system above the ceiling has been described with reference to FIG. 10.

Thus far, the various embodiments of the present invention have, been described with reference to FIGS. 1 through 10.

In the above described embodiments, the auxiliary mounting device for the in ceiling speaker system comprises a pair of symmetric elongate elements a the pair of symmetric vertical portions. In an alternative to this symmetric structure, they may have an asymmetric structure. In a further alternative, the auxiliary mounting device may comprise one elongate element and one vertical portion.

Furthermore, in the above described embodiments, the ceiling reinforcing element has the circular flat plate portion. In an alternative to this, the flat plate portion may be partially cut to form a substantially C-shape. A center opening portion of the substantially C-shaped flat plate portion corresponds to the "opening" of the flat plate portion. In a further alternative, the flat plate portion may be foldable. Such a construction makes it possible that the ceiling reinforcing element easily passes through the opening formed in the ceiling material to allow the in ceiling speaker system to be mounted therethrough. As a result, mounting operation is easily carried out.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

In accordance with an auxiliary mounting device for an in ceiling speaker system of the present invention, the in ceiling speaker system is firmly mounted to a ceiling structure in which construction elements protrude upward from a rear surface of a ceiling material. In addition, the auxiliary mounting device is capable of preventing the in ceiling speaker system from falling off. Therefore, the auxiliary mounting device of the present invention is useful in technical fields of the in ceiling speaker system.

The invention claimed is:

1. An auxiliary mounting device for an in ceiling speaker system, comprising:

a ceiling reinforcing element;

an elongate element; and an intermediate element, the intermediate element mounted to the elongate element such that the intermediate element is capable of being in a horizontally slidable state and in a horizontally fixed state;

wherein the ceiling reinforcing element includes a flat plate portion provided horizontally on a rear surface of a ceiling plate and having an opening at a center portion thereof, and a vertical portion provided to extend vertically from the flat plate portion, the elongate element is provided to extend on a horizontal plane, the vertical portion is mounted to the intermediate element such that the vertical portion is capable of being in a vertically slidable state and in a vertically fixed state, and wherein the vertical portion is vertically slidable relative to the intermediate element and the elongate element when in the vertically slidable state and is vertically fixed relative to the intermediate element and the elongate element when in the vertically fixed state;

wherein the intermediate element is horizontally slidable relative to the elongate element when in the horizontally slidable state and is horizontally fixed relative to the elongate element when in the horizontally fixed state;

and wherein the vertical portion may be in the vertically slidable state when the intermediate element is in the horizontally fixed state, and wherein the vertical portion may be in the vertically fixed state when the intermediate element is in the horizontally slidable state.

2. The auxiliary mounting device for the in ceiling speaker system according to claim 1, wherein the elongate element is one of a pair of elongate elements, the vertical portion is one of a pair of vertical portions which are provided to extend vertically from the flat plate portion at substantially the opposite positions with the opening interposed between the pair of vertical portions, and the pair of elongate elements are provided substantially in parallel with each other on the horizontal plane so as to respectively correspond to the pair of vertical portions.

3. The auxiliary mounting device for the in ceiling speaker system according to claim 1, further comprising:

the intermediate element is disposed between the vertical portion and the elongate element.

4. The auxiliary mounting device for the in ceiling speaker system according to claim 1, wherein the intermediate element includes a first mounting portion by which the intermediate element is mounted to the elongate element, and a second mounting portion by which the vertical portion is mounted to the intermediate element, and the first mounting portion and the second mounting portion are located at different positions in a vertical direction.

5. The auxiliary mounting device for the in ceiling speaker system according to claim 4, wherein the elongate element includes a first flat portion extending in band shape in the longitudinal direction of the elongate element, a second flat portion located adjacent the first flat plate portion so as to extend in band shape in the longitudinal direction of the elongate element, and a third flat portion located adjacent the second flat portion so as to extend in band shape in the longitudinal direction of the elongate, the first flat portion, the second flat portion, and the third flat portion form a substantially U-shape in a transverse cross-section of the elongate element, and the second flat portion is provided with a mounting portion by which the intermediate element is mounted to the elongate element.

6. The auxiliary mounting device for the in ceiling speaker system according to claim 4, the first mounting portion has a horizontally extending slit.

7. An auxiliary mounting device for an in ceiling speaker system, comprising:

an elongate element;

an intermediate element mountable to the elongate element;

the intermediate element horizontally adjustable in a direction parallel to the elongate element and arranged to be fixed relative to the elongate element in a plurality of horizontal positions;

a ceiling reinforcing element, the ceiling reinforcing element including a central opening, a flat portion surrounding the central opening, and a vertical portion extending vertically relative to the flat portion, the vertical portion mountable to the intermediate element;

the vertical portion vertically adjustable in a direction perpendicular to the elongate element and arranged to be fixed relative to the elongate element in a plurality of vertical positions; and wherein the vertical portion may be horizontally adjusted to one of the plurality of horizontal positions while fixed in one of the plurality of vertical positions; and wherein the vertical portion may be vertically adjusted to one of the plurality of vertical positions while fixed in one of the plurality of horizontal positions.

8. The device of claim 7, wherein the intermediate element includes a first mounting portion having a pair of horizontally oriented slits for mounting to the elongate element and a second mounting portion disposed above the first mounting portion and having a pair of mounting holes for mounting to the vertical portion.

9. The device of claim 8, wherein the elongate element comprises a vertically oriented flat portion, the horizontally oriented slits and the pair of mounting holes formed in the flat portion.

10. An auxiliary mounting device for an in ceiling speaker system, comprising:

an elongate element;

an intermediate element;

the elongate element and the intermediate element mounted to one another by at least one horizontally oriented slit to permit sliding horizontal adjustment of the intermediate element relative to the elongate element between a plurality of horizontally fixed positions;

a ceiling reinforcing element, the ceiling reinforcing element including a central opening, a flat portion surrounding the central opening, and a vertical portion extending vertically relative to the flat portion;

the vertical portion and the intermediate element mounted to one another by at least one vertically oriented slit to permit sliding vertical adjustment of the vertical portion relative to the intermediate element between a plurality of vertically fixed positions;

wherein the vertical portion may be horizontally adjusted relative to the elongate element while in one of the plurality of vertically fixed positions; and wherein the vertical portion may be vertically adjusted relative to the elongate element and the intermediate element while in one of the plurality of horizontally fixed positions.

11. The device of claim 10, wherein the intermediate element is disposed parallel to the elongate element.

* * * * *